US008887459B2

(12) United States Patent
Wheeler

(10) Patent No.: US 8,887,459 B2
(45) Date of Patent: Nov. 18, 2014

(54) MODULAR WALL ASSEMBLY SYSTEM

(71) Applicant: Joseph Wheeler, Blacksburg, VA (US)

(72) Inventor: Joseph Wheeler, Blacksburg, VA (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 0 days.

(21) Appl. No.: 13/898,180

(22) Filed: May 20, 2013

(65) Prior Publication Data

US 2013/0305638 A1 Nov. 21, 2013

Related U.S. Application Data

(60) Provisional application No. 61/649,267, filed on May 19, 2012.

(51) Int. Cl.
*E04B 2/58* (2006.01)
*E04B 2/72* (2006.01)
*E04B 2/74* (2006.01)

(52) U.S. Cl.
CPC ..... *E04B 2/7457* (2013.01)
USPC ..... 52/238.1; 52/36.5; 52/242; 52/481.2; 52/483.1; 52/511

(58) Field of Classification Search
USPC ..... 52/36.5, 36.6, 317, 238.1, 239, 241, 52/481.1, 481.2, 483.1, 489.1, 489.2, 290, 52/846, 655.1, 715, 508, 510, 511; 248/250, 225.21, 224.51, 300; 312/245, 246; 211/191, 192
See application file for complete search history.

(56) References Cited

U.S. PATENT DOCUMENTS

| | | | | | |
|---|---|---|---|---|---|
| 876,399 | A | * | 1/1908 | Robinson | 52/714 |
| 1,001,355 | A | * | 8/1911 | Chipley | 238/89 |
| 1,981,239 | A | * | 11/1934 | Manske | 52/220.7 |
| 2,103,064 | A | * | 12/1937 | Clark | 52/696 |
| 3,090,164 | A | * | 5/1963 | Nelsson | 52/346 |
| 3,271,920 | A | * | 9/1966 | Downing, Jr. | 52/481.1 |
| 3,680,271 | A | * | 8/1972 | Satchell | 52/656.1 |
| 3,845,601 | A | * | 11/1974 | Kostecky | 52/290 |
| 4,074,489 | A | | 2/1978 | Eckel | |
| 4,281,491 | A | | 8/1981 | Schonert | |
| 4,719,730 | A | * | 1/1988 | Winkowski | 52/238.1 |
| 4,796,541 | A | * | 1/1989 | Halstrick | 108/107 |
| 4,811,539 | A | * | 3/1989 | Menchetti | 52/489.2 |
| 5,060,434 | A | * | 10/1991 | Allison | 52/238.1 |
| 5,187,908 | A | | 2/1993 | Losensky | |
| 5,216,859 | A | * | 6/1993 | Moreno et al. | 52/238.1 |
| 5,222,335 | A | * | 6/1993 | Petrecca | 52/105 |

(Continued)

FOREIGN PATENT DOCUMENTS

| | | | |
|---|---|---|---|
| WO | 2008032229 | A | 3/2008 |
| WO | 2011053629 | A | 5/2011 |

*Primary Examiner* — Robert Canfield
(74) *Attorney, Agent, or Firm* — New River Valley IP Law, PC; Michele L. Mayberry

(57) ABSTRACT

Provided are systems and components for modular wall assembly. The components include horizontal tracks, vertical studs, and floor tracks that have engagement means for assembling the components together into a frame structure. Horizontal tracks and floor tracks have portions for mourning a wall module such as a wall panel unit, bookshelf unit, or cabinet. The horizontal tracks, vertical studs, and floor studs may be CNC cut from a CAD file for precision alignment between interlocking components. The modular wall assembly systems provide for ease of construction and flexibility in designing the layout of an interior wall.

12 Claims, 11 Drawing Sheets

(56) References Cited

U.S. PATENT DOCUMENTS

| | | | | |
|---|---|---|---|---|
| 5,377,470 | A | 1/1995 | Hebinck | |
| 5,394,665 | A * | 3/1995 | Johnson | 52/241 |
| 5,524,412 | A | 6/1996 | Corl | |
| 5,555,689 | A * | 9/1996 | Gilmore | 52/489.1 |
| 5,632,127 | A * | 5/1997 | Agar et al. | 52/481.2 |
| 5,791,498 | A * | 8/1998 | Mills | 211/26 |
| 6,389,778 | B1 | 5/2002 | Strange | |
| 6,568,138 | B1 * | 5/2003 | Frost et al. | 52/241 |
| 6,647,691 | B2 * | 11/2003 | Becker et al. | 52/656.1 |
| 6,718,717 | B2 | 4/2004 | Henderson et al. | |
| 6,857,237 | B1 | 2/2005 | Dalphond et al. | |
| 6,983,569 | B1 | 1/2006 | Rosenberg | |
| 7,469,512 | B2 | 12/2008 | Faber et al. | |
| 7,850,390 | B2 * | 12/2010 | Lisbona | 403/382 |
| 7,987,648 | B1 | 8/2011 | Ryan | |
| 8,322,102 | B2 | 12/2012 | Krieger | |
| 2002/0112411 | A1 * | 8/2002 | Gravel et al. | 52/36.1 |
| 2006/0137277 | A1 | 6/2006 | Katwyk et al. | |
| 2007/0258196 | A1 * | 11/2007 | Koskinen et al. | 361/681 |
| 2011/0146180 | A1 * | 6/2011 | Klein | 52/317 |
| 2011/0277417 | A1 | 11/2011 | Welcel | |
| 2013/0031858 | A1 | 2/2013 | Schiffmann et al. | |
| 2013/0048812 | A1 * | 2/2013 | Lozano | 248/220.22 |

* cited by examiner

MODULAR WALL ASSEMBLY SYSTEM

CROSS REFERENCE TO RELATED APPLICATIONS

This application claims priority to and the benefit of the filing date of U.S. Provisional Application No. 61/649,267, filed on May 19, 2012, the disclosure of which is hereby incorporated by reference herein in its entirety.

BACKGROUND OF THE INVENTION

1. Field of the Invention

The present invention is related to modular wall assembly systems for the construction industry. More particularly, the present invention relates to modular wall assembly systems comprising a metal frame and replaceable wall modules such as wall panel units, bookshelf units, or cabinets for mounting on said frame.

2. Description of Related Art

Wood frames for assembly of walls have been the conventional choice of builders, and modular wall framing systems made of wood, such as the system described in U.S. Pat. No. 4,281,491 are known, which patent is hereby incorporated by reference herein in its entirety. Wood, however, can often change shape or fragment over time through buckling, warping, or splitting and is not fireproof. Metal presents an attractive alternative to wood because it lacks these disadvantages and is also cheaper and lighter.

With respect to the home, it is often desirable to remodel or redecorate such as changing the décor of a wall, replacing cabinets, or adding a bookshelf or entertainment center. However, such remodeling projects are often costly, time-consuming, messy, and disruptive for the homeowner. U.S. Pat. No. 7,987,648 discloses a modular wall panel system that allows for placement and replacement of decorative panels, which patent is hereby incorporated by reference herein in its entirety. The system relies on a skeletal frame attached to an existing wall surface, but is not compatible with a modular metal frame infrastructure.

U.S. Pat. No. 6,983,569, which is hereby incorporated by reference herein in its entirety, describes a modular metal wall framing system for construction of walls. However, it is configured for permanent placement of dry wall and thus does not allow for flexibility of placement of wall modules such as decorative panels, bookshelves, cabinets, etc. or for redecoration or remodeling without the aforementioned disadvantages of such projects. Thus, there is a need for an improved modular wall assembly system made of metal components that provides for such flexibility.

SUMMARY OF THE INVENTION

The present invention addresses issues commonly found in existing systems by providing a system for modular wall assembly. Developed for the industrialized process of construction, the system of the present invention comprises metal wall framing components including vertical studs and horizontal tracks or cleats. The studs and tracks have female and male engagement means that preferably are slots and tabs for precision alignment between all interlocking components and may be computer numerical control (CNC) cut from a computer-aided design (CAD) file.

Representative modular wall assembly systems according to embodiments of the invention can comprise: a frame, such as metal, comprising: (i) at least one hanging bracket comprising a pair of first male engagement tabs and at least one first wall module engagement cleat; (ii) at least one floor track comprising at least one second male engagement tab and at least one second wall module engagement cleat; and (iii) a pair of vertical studs comprising a series of first female engagement voids configured to receive said first male engagement tabs of the bracket and a series of second female engagement voids configured to receive said second male engagement tabs of the floor track; and at least one wall module comprising at least one horizontal slot configured to receive the first or second wall module engagement cleats such that when installed the wall module is supported on the studs by way of the brackets.

In embodiments, the systems of the invention may include at least one hanging bracket comprising at least one horizontal track (e.g., cleats) and with indexed tabs that interlock with incremental slots in the vertical studs. The horizontal tracks or cleats may be used for hanging wall modules and/or wall systems including shelves and various wall accessories. The wall modules preferably have a horizontal track receiving means or groove, for example which may be a horizontal slot that mates with the horizontal track and secures the module in place at the precise elevation. The incremental slots in the studs may allow for several options for track location to accommodate flexibility for different wall installations. For deeper wall cavities, the horizontal tracks may be so configured that they project deep into a wall to hang deep elements such as bookcases or cabinetry.

For baseboards, the horizontal floor track may include portions or tabs that fold outwardly to engage corresponding slots or grooves in the baseboard panel. The metal wall framing components may include insulation attached to the face of the framing components such as a thin foam strip to insure a tight seal and provide acoustical protection.

In embodiments, a modular wall assembly system is provided, comprising: (a) a metal frame, comprising: (1) at least one horizontal track; (2) a floor track; and (3) a pair of vertical studs; and (b) a wall module; wherein: (c) said at least one horizontal track comprises a pair of first male engagement means and a first wall module engagement portion; (d) said floor track comprises second male engagement means and second wall module engagement portions; (e) said vertical studs comprise a series of female engagement means positioned at increments; (f) said wall module comprises a series of horizontal slots positioned at increments; (g) said incremental female engagement means of said vertical studs are configured to receive said first male engagement means of said at least one horizontal track; (h) said horizontal slots on said wall module are configured to receive said first and second wall module engagement portions; (i) said floor track is configured to receive said vertical studs wherein said female engagement portions of said vertical studs are configured to receive said second male engagement means of said floor track; and (j) said increments of said horizontal slots of said wall module are spaced such that when the frame is assembled, said wall module may be supported on said frame through said wall module engagement portions of said at least one horizontal track and said floor track. In another aspect of embodiments, said at least one horizontal track further comprises: (a) a flat, longitudinally-extended rectangular base; and (b) an orthogonal projection in communication with said base; wherein: (c) said first male engagement means are positioned at the top long side at the ends and protrude on one side of said base; (d) said wall module engagement portion is a strip that is positioned at the top long side of said base and protrudes on the opposite side of said base as male engagement means, and; (e) said orthogonal projection protrudes on the same side of said base as said first male engagement means.

In another aspect of embodiments, said vertical studs further comprise: (a) a flat rectangular base; and (b) two parallel side walls which are bent at right angles of said base projecting from the same side and in communication with said base; wherein said female engagement means are positioned at increments along said side walls and said base.

In another aspect of embodiments, said floor track further comprises: (a) a flat rectangular base; and (b) two parallel side walls which are bent at right angles of said base projecting from the same side and in communication with said base; wherein said second male engagement means and said second wall module engagement means are positioned along said side walls of said floor track.

In another aspect, said first male engagement means are tabs that fold at a downward angle on the same side of said base as said orthogonal projection.

In another aspect, said first male engagement means are hooks, ridges, or knobs.

In another aspect, said second male engagement means are a pair of tabs capable of folding inward to engage the female engagement means (e.g., voids) of the studs.

In another aspect, said second male engagement means can be provided as tabs, hooks, ridges or knobs. In embodiments, the floor track can comprise a single unitary sheet of metal comprising cuts to form the first and/or second male engagement tabs. Alternatively, or in addition, the sheet metal can be folded to provide side walls. In a similar manner, the studs can be prepared such that the first and second female engagement means (e.g., voids) are the same or different size and shape and are configured for engagement with the first and or second male engagement tabs. Likewise, the studs can comprise a single sheet of metal that is folded to provide a main wall and two parallel side walls disposed perpendicular to the main wall. Further, the first female engagement voids can be disposed in the main wall of the studs while the second female engagement voids are disposed in the side walls.

In another aspect of the invention, said female engagement means are slots for receiving tabs that fold at a downward angle.

In another aspect of the invention, said female engagement means are slots for receiving a pair of tabs that fold inward.

In another aspect of the invention, said first and second wall module engagement portions are positioned at an upward angle and said horizontal slots of said wall module are positioned at a downward angle for receiving said portions.

In another aspect of embodiments, said horizontal tracks, floor track, and vertical studs are made of CNC cut sheet metal.

In another aspect, said wall module is made of CNC cut fiberboard.

In another aspect of embodiments, said wall module is a wall panel unit, book shelf unit, bookcase, cabinet, or entertainment center.

In another aspect, said wall panel unit is configured to accommodate electrical components, data ports, cable TV outlets, communications ports, or speakers.

In another aspect, one or more components of said system are insulated and/or the system can comprise foam or foam strips for insulation or acoustic needs.

These and other aspects and embodiments of the invention will be readily apparent in the foregoing detailed description and drawings.

DETAILED DESCRIPTION OF VARIOUS EMBODIMENTS OF THE INVENTION

Reference will now be made in detail to various exemplary embodiments of the invention. The embodiments described in the description and shown in the figures are illustrative only and are not intended to limit the scope of the invention. Changes may be made in the specific embodiments described in this specification and accompanying drawings that a person of ordinary skill in the art will recognize are within the scope and spirit of the invention and still fall within the scope of embodiments of the invention.

Figure 1:
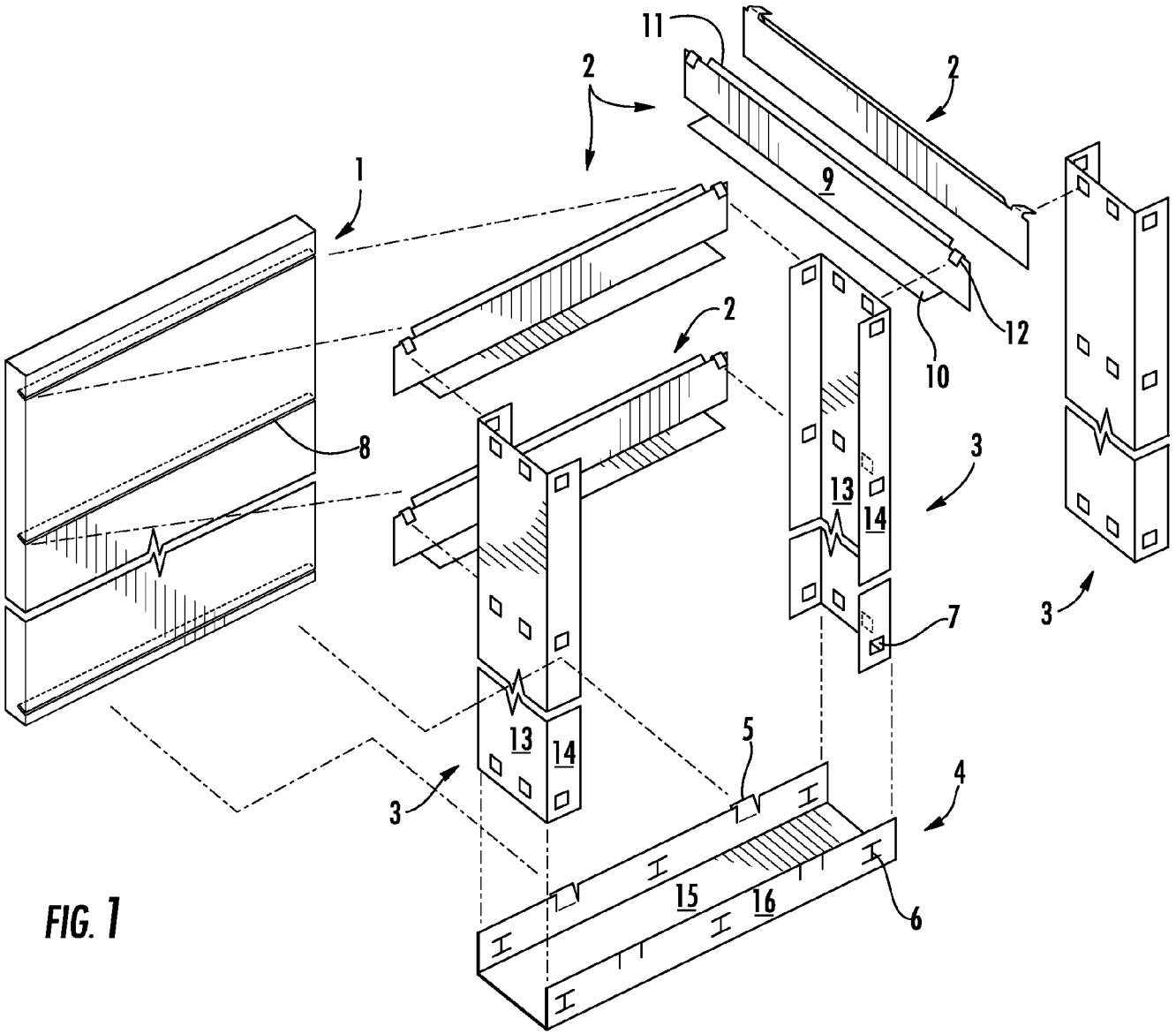
FIG. 1 is a schematic diagram showing an embodiment of a modular wall assembly system according to the invention.

FIG. 1 shows an embodiment of a modular wall assembly system according to the invention. As shown in FIG. 1 is a modular wall assembly system, comprising: a metal frame, comprising: (i) at least one hanging bracket 2 comprising a pair of first male engagement tabs 12 and at least one first wall module engagement cleat 11; (ii) at least one floor track 4 comprising at least one second male engagement tab 6 and at least one second wall module engagement cleat 5; and (iii) a pair of vertical studs 3 comprising a series of first female engagement voids 7 configured to receive said first male engagement tabs 12 of the bracket 2 and a series of second female engagement voids 7 configured to receive said second male engagement tabs 6 of the floor track 4; and at least one wall module 1 comprising at least one horizontal slot 8 configured to receive the first or second wall module engagement cleats 11, 5 such that when installed the wall module is supported on the studs 3 by way of the brackets 2.

More particularly, horizontal tracks 2, otherwise referred to as brackets 2, can comprise a flat, longitudinally-extended rectangular base or support bar 9 as the main body of the track/bracket, and may have first male engagement means 12 such as tabs in communication with said base 9 disposed for example at a downward angle relative to support 9. The first male engagement means 12 may be preferably positioned at the ends of the base 9 projecting on one side of the base at the top. The base 9 may further comprise on the same side as the male engagement means 12 and in communication with said base an orthogonal projection 10 on the bottom long side of said base 9. On the opposite side of the base 9 and preferably at the top, a first wall module engagement portion 11, or cleat, which may be a strip may be in communication with said base 9 at an upward angle. In embodiments, cleat 11 and male engagement tabs 12 may be cut from the same sheet of material and may be bent to an angular position relative to support 9, such that cleat 11 and tabs 12 lie in the same plane. As shown, cleat 11 is disposed between tabs 12 along the top edge of bracket 2.

As further depicted in FIG. 1, vertical studs 3 may comprise a flat rectangular base 13, otherwise referred to as a main wall, with two parallel side walls 14 which are bent or otherwise disposed at right angles to said base 13 projecting from the same side. Vertical studs 3 may further comprise incremental female engagement means 7, or voids, at spaced intervals along said base 13 and both side walls 14. Incremental female engagement means 7, otherwise referred to as voids, of vertical studs 3 can be configured to mate with one or more male engagement means 12 on horizontal tracks 2 (hanging brackets) as shown. As further depicted in FIG. 1, floor track 4 may be similarly configured as vertical studs 3, having a flat rectangular base 15 with two orthogonal side walls 16. Vertical studs 3 may be dimensioned in width so that side walls 14 fit within side walls 16 of floor track 4 when upright. Alternatively, or in addition, female engagement voids 7 of the studs may be shaped, sized, and disposed in the studs in a manner to interact with and receive male engagement tabs 6 when the studs are disposed in the floor track. Floor track 4 may further have second wall module engagement portions 5, projecting outward at an upward angle along top of side walls 16 as well as second male engagement means 6 positioned in the mid-portion of sidewalls 16.

As further depicted in FIG. 1, vertical studs 3 may be fitted in floor tracks 4 in an upright position and horizontal tracks 2 may be fitted on two vertical studs 4 to complete a frame for mounting a wall module 1 such as a wall panel unit or similar module such as a book shelf unit, bookcase, cabinet, or entertainment center. The wall module 1 may be joined to the frame through horizontal slots 8 that are configured at a downward angle to fit wall module engagement portion 11 of horizontal tracks 2 and wall module engagement portions 5 of floor tracks 4. In this manner, and unlike drywall, the wall modules can be disposed on the frame quickly and easily without the need for screws. Additionally, the wall panels can be replaced with another wall panel, especially in the case where the décor is outdated or damaged. The wall panels can be comprised or any material suitable for a wall, including without limitation drywall, plywood, medium density fiberboard (MDF), corian, stone, cement, glass, and so on.

Horizontal tracks 2, vertical studs 3, and floor tracks 4 may be fabricated from a sheet metal material such as stainless steel or aluminum. For these components, three-dimensional models may be rendered in CAD software detailing their specifications, which may be then encoded in instructions to CNC machines for fabricating these components from sheet metal. In preferred embodiments, the tracks, studs, and brackets can each be cut from a single sheet of metal and then cut and folded into the desired configuration. Features for mating the components such as tabs and holes may be positioned for precise alignment between all interlocking components.

First 12 and second 6 male engagement means may be any projection such as tabs, hooks, ridges, or knobs that may fit a corresponding female engagement means such as 7, i.e. an opening dimensioned to mate with the male engagement means. In a preferred embodiment tabs are used. Tabs may take any shape or configuration, such as a single rectangular tab that folds downward at an angle from the base 9 of the horizontal track 2 as indicated by 12 or the pair of tabs that fold sideways from the side walls 16 of the floor track 4 as indicated by 6. On horizontal track 2 first male engagement means 12 may be spaced at both ends of the track 2 and on floor track 4 second male engagement means 6 may be spaced at regular intervals such as depicted in FIG. 1. The male engagement tabs 6 disposed in the floor track 4 can comprise any of numerous configurations. For example, as shown, cuts can be provided in the sheet metal that forms the floor track 4 such that an "H" shape defines the outline of the male tabs 6. During use, when the stud is placed in the floor track and aligned therein, the male tabs 6 can be pushed inwardly with a screwdriver to engage female engagement voids of the studs to secure the studs. Other configurations for this function can include circular cut outs in the floor track and corresponding circular cutouts in the studs. In this manner, the holes in the studs can be aligned with the holes in the floor track to ensure proper alignment of the components, then screws, rivets, bolts, etc. can be used to secure the components together. Alternatively or in addition, the cuts in the sheet metal providing the male engagement tabs can be half-moon shaped punches or cuts, which can then be punched inwardly toward the studs to engage the female engagement voids and align/secure the studs with/to the floor track. The number and spacing of second male engagement means 6 or second wall module engagement portions 5 will depend on the length of the floor track 4. For example, for longer floor tracks 4 for accommodating wider wall modules 1, it may be desirable to include more than two wall module engagement portions of configuration 5 or more than 3 tabs of configuration 6 along side wall 16 of said floor track 4.

Female engagement means 7 of vertical studs 3 may take any form to receive corresponding first male engagement means 12 of horizontal tracks 2 and second male engagement means 6 of floor tracks 4 and may be regularly spaced as shown in FIG. 1. Further, vertical studs 3 may have a variety of lengths to accommodate taller wall panels 1, and in such cases may have more than three female engagement means 7 along any particular base 13 or side wall 14 to accommodate additional horizontal tracks 2 for attachment of wall panels 1. For example, vertical studs may have 4 or more, 5 or more, 6 or more, 7 or more, 8 or more, 9 or more, 10 or more, 11 or more, or even 12 or more female engagement means 7 regularly spaced along the base 13 and side walls 14 of vertical studs 3. The female engagement means 7 will preferably be spaced at the same intervals along the base 13 and side walls 14 so they are aligned at the same level.

Figure 2:
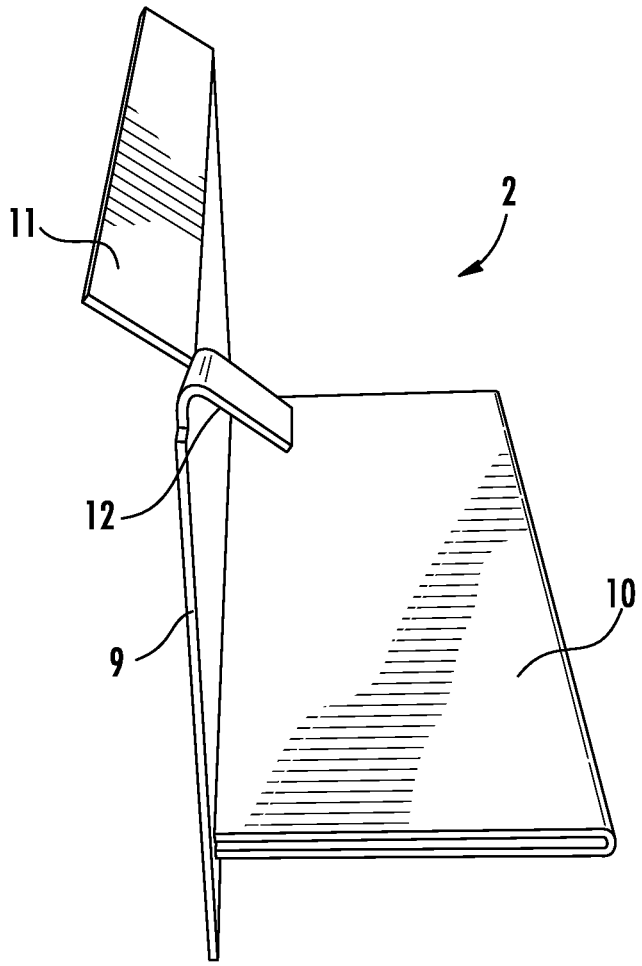
FIG. 2 is a schematic drawing showing a side view of an embodiment of a horizontal track according to the invention.

FIG. 2 shows a side view of an embodiment of a horizontal track 2 according to the invention. Such systems as shown in FIG. 2 can for example comprise at least one hanging bracket comprising: a flat, longitudinally-extended rectangular support bar; and an orthogonal projection in communication with the support bar; wherein the first male engagement tabs are disposed at opposing ends of the support bar and protrude on one side of the support bar; wherein the wall module engagement cleat is disposed between the first male engagement tabs and protrudes on an opposing side of the support bar as the first male engagement tabs; and wherein the orthogonal projection protrudes on the same side of the support bar as the first male engagement tabs.

More particularly, male engagement means 12 on the top of the track 2 at the ends are configured for mating with female engagement means 7 on vertical studs 3. Wall module engagement portion 11 may project at an upward angle on the other side of the track 2 between male engagement means 12 as shown for mating with slots 8 of corresponding configuration in wall modules 1. Also shown is orthogonal projection 10 on the bottom side of the track 2 projecting on the same side as male engagement means 12.

In another embodiment of the invention a horizontal track 2 is installed on two parallel vertical studs 3 and in another embodiment a horizontal track 2 is installed on the side walls 14 of two vertical studs 3. Male engagement means (hidden on inside of stud) of horizontal track 2 are mated with female engagement means 7 on the side walls 14 of vertical studs 3. Wall module engagement portion 11 projects outward from base 9 at top of installed track 2 while orthogonal projection 10 fits inward between the vertical studs 3.

In an embodiment an alignment punch tab system according to the invention can be disposed between the floor and the vertical stud 3. Floor track 4 with punch tab 6 at end of side wall 16 of floor track 4 can be aligned with female engagement means 7 of side wall 14 of vertical stud 3. Bolts, screws, rivets, etc. may additionally or alternatively be used to secure and/or align vertical studs 3 to/with floor tracks 4.

Figure 3:
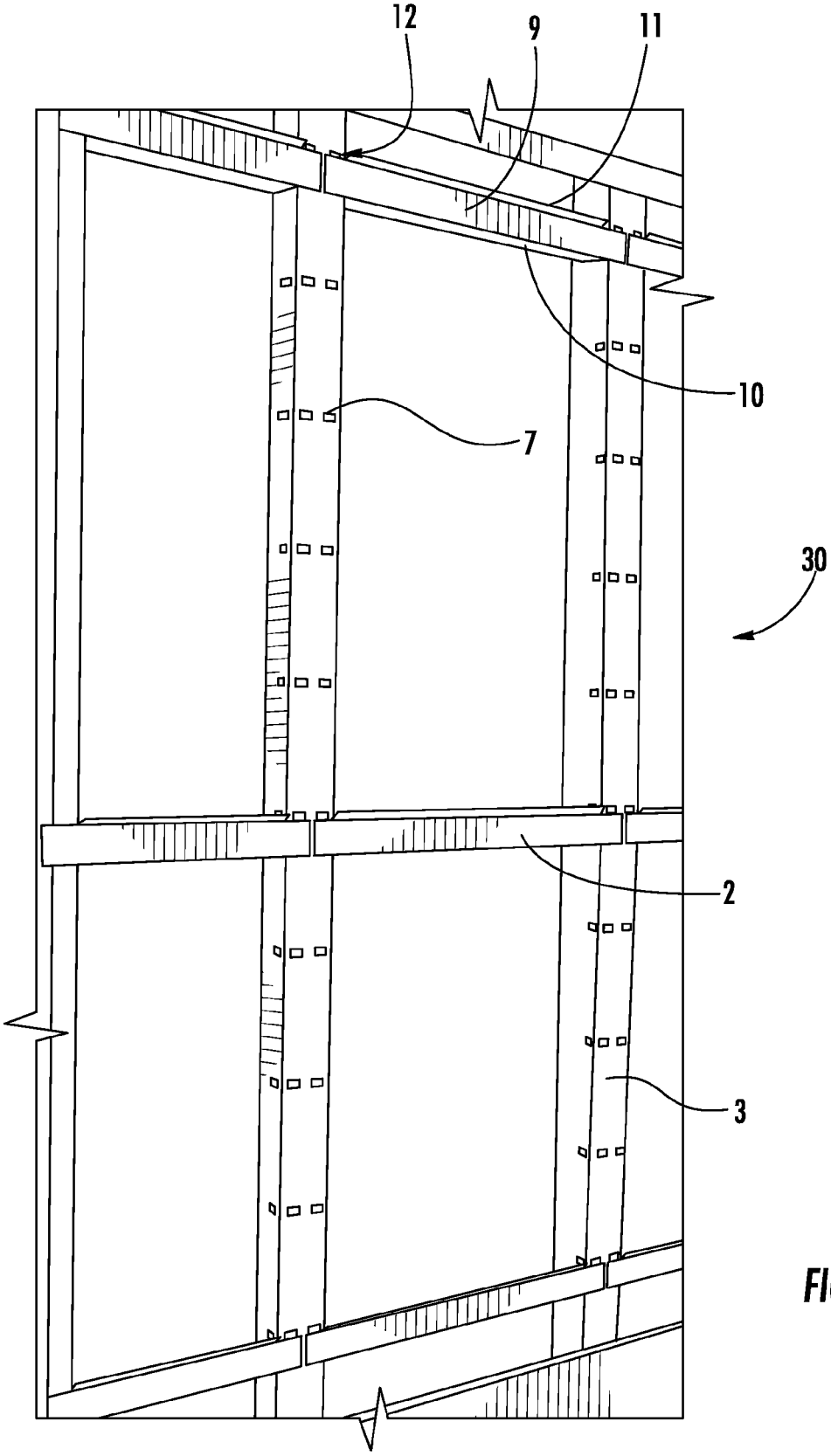
FIG. 3 is a schematic drawing showing a front view of an embodiment of an assembled frame according to the invention.

FIG. 3 shows an assembled frame 30 with vertical studs 3 and horizontal tracks 2 ready for installment of wall module 1. As shown in FIG. 3, such systems can comprise one or more vertical studs comprising: a flat rectangular main wall; and two parallel side walls disposed at right angles to the main wall; wherein the first female engagement voids are disposed at increments along the main wall and the second female engagement voids are disposed at increments along the side walls. Further as shown in FIG. 3, such systems can alternatively or in addition comprise one or more floor tracks comprising: a flat rectangular base; and two parallel track walls disposed at right angles to the base; wherein the second male engagement tab and the second wall module engagement cleat are disposed in at least one of the parallel track walls. For example, the assembled frame 20 may be secured in place by attaching floor tracks 4 to floorboards and vertical studs 3 to ceiling tracks through the use of various fastener components such as bolts, screws, nuts, and washers.

Figure 4:
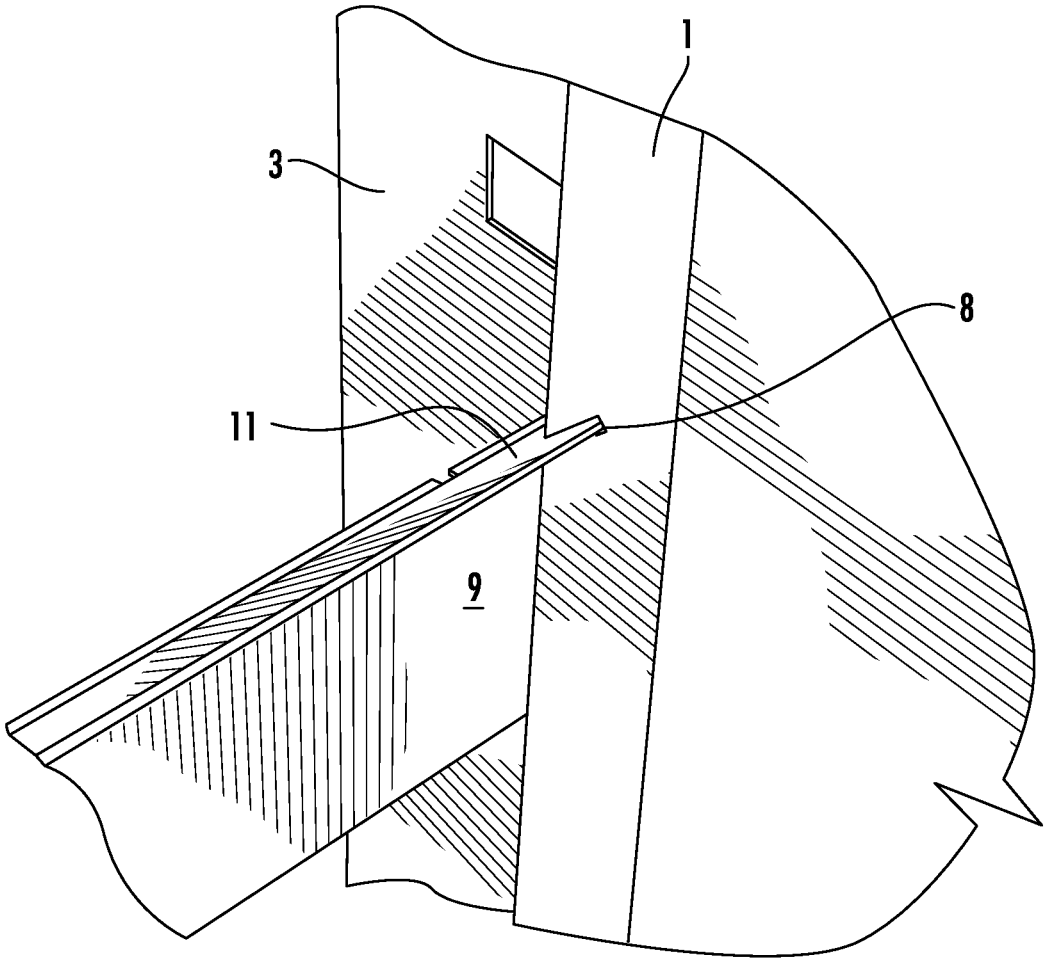
FIG. 4 is a schematic drawing showing an enlarged view of an embodiment of one end of a horizontal track mounted on a vertical stud with wall module being mounted on the horizontal track according to the invention.
Figure 10:
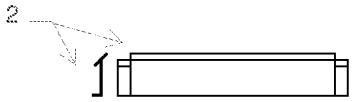
FIGS. 10 and 11 are schematic drawings showing a shelving unit (FIG. 11) being inserted into a wall assembly frame (FIG. 10) according to embodiments of the invention.
Figure 11:
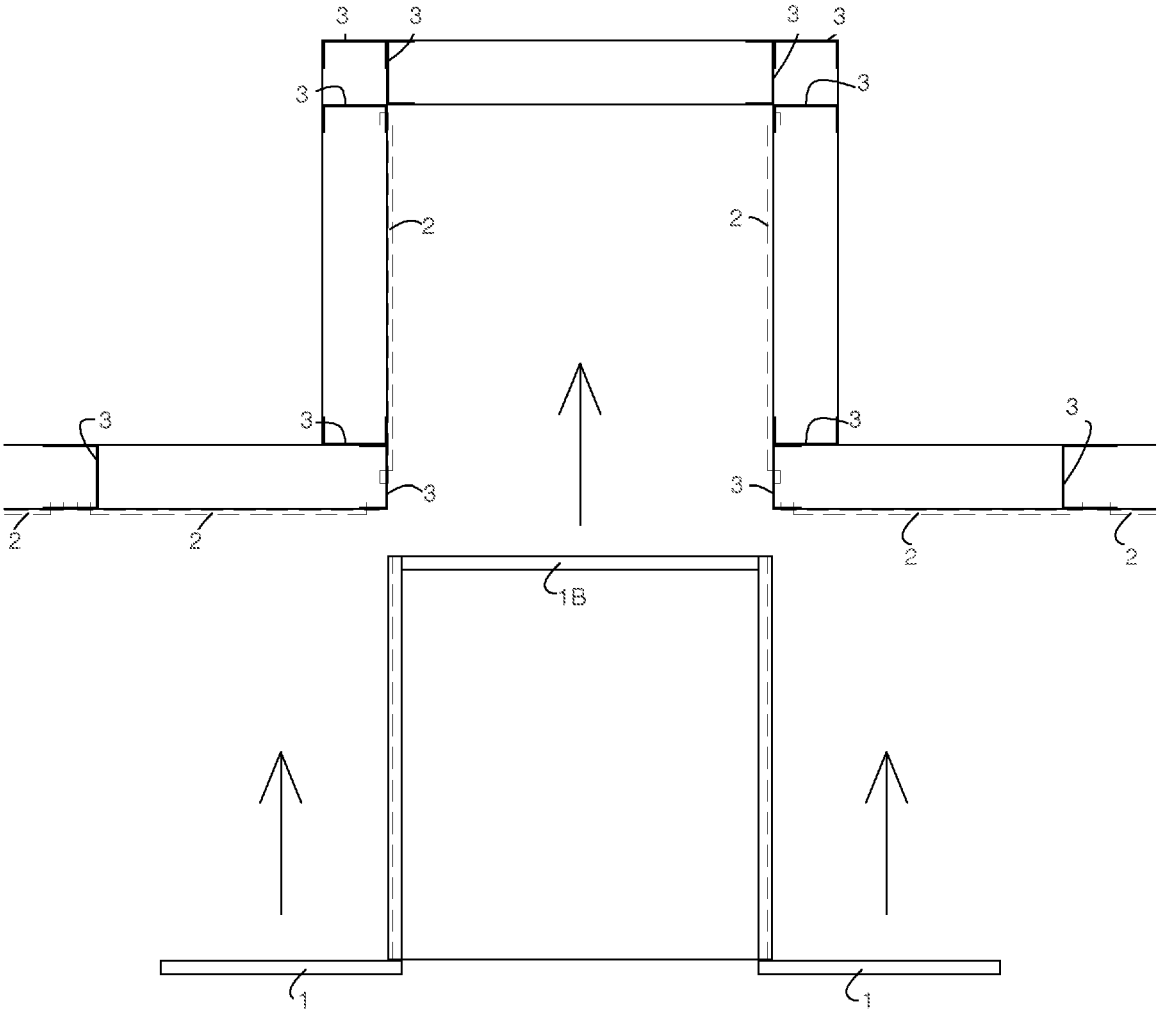

FIG. 4 shows a wall panel 1 with horizontal slot 8 mated with wall module engagement portion 11 of horizontal track 2. Wall modules 1 may be easily installed on an assembled frame 20 by lining up horizontal slots 8 of a wall module 1 with horizontal track wall module engagement portions 11 and floor track wall module engagement portions 5 and exerting pressure at a downward angle on wall panel 1 to mate wall module 1 with horizontal tracks 2 and floor track 4 of frame 20. Alternatively, wall modules 1 may be installed on the assembled frame 20 by lining up ends of wall module engagement portions of horizontal tracks 2 and floor tracks 4 with horizontal slots 8 of wall modules 1 and sliding the modules sideways until wall module 1 is fully installed on the assembled frame. FIGS. 10-12 show the latter method of installment wherein a bookcase unit 1A is mated with frame 20 through horizontal slot 8 and slid sideways along assembled frame 20 until it is completely installed.

Figure 5:
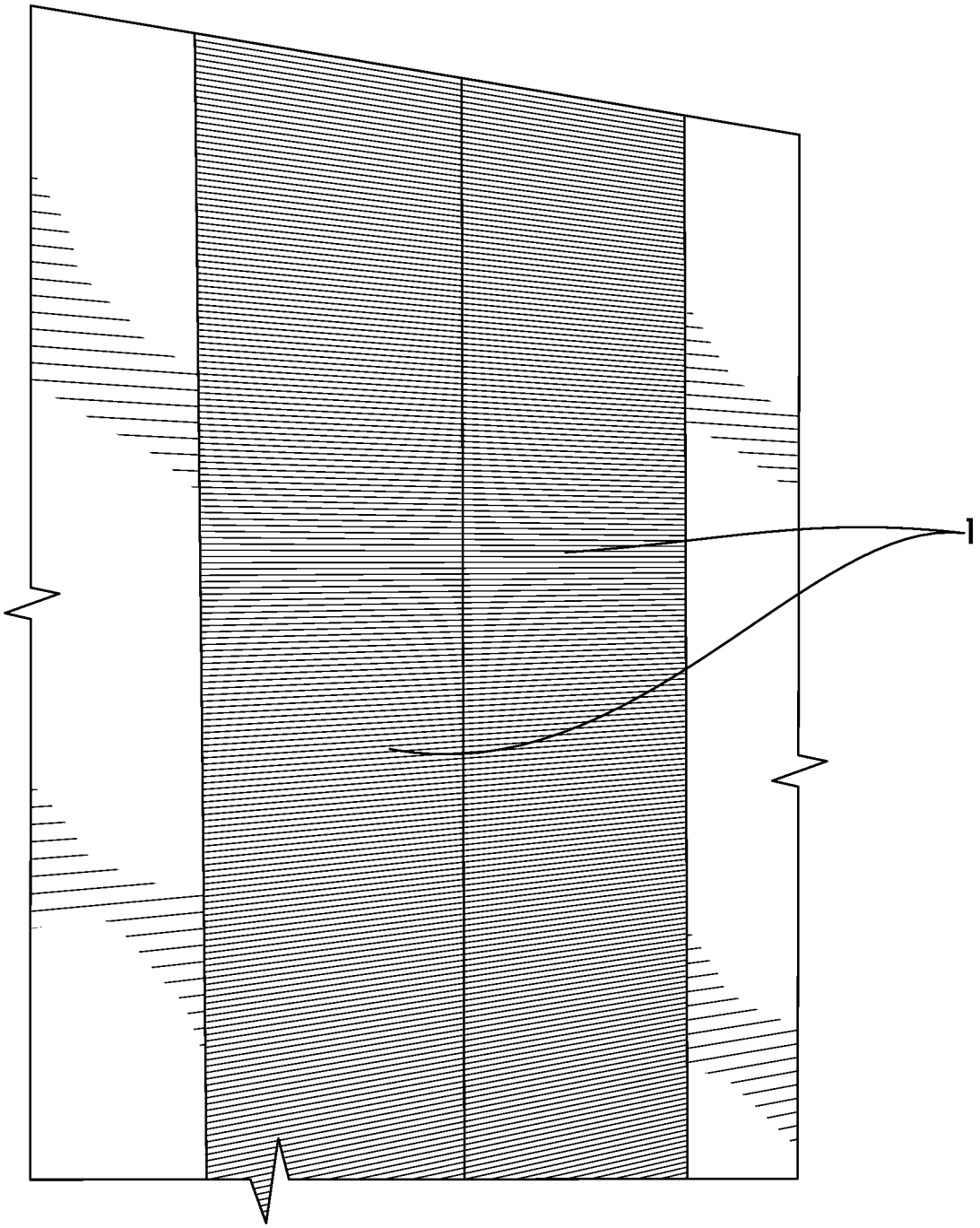
FIG. 5 is a schematic drawing showing an embodiment of wall panel units mounted on an assembled frame according to the invention.
Figure 6A:
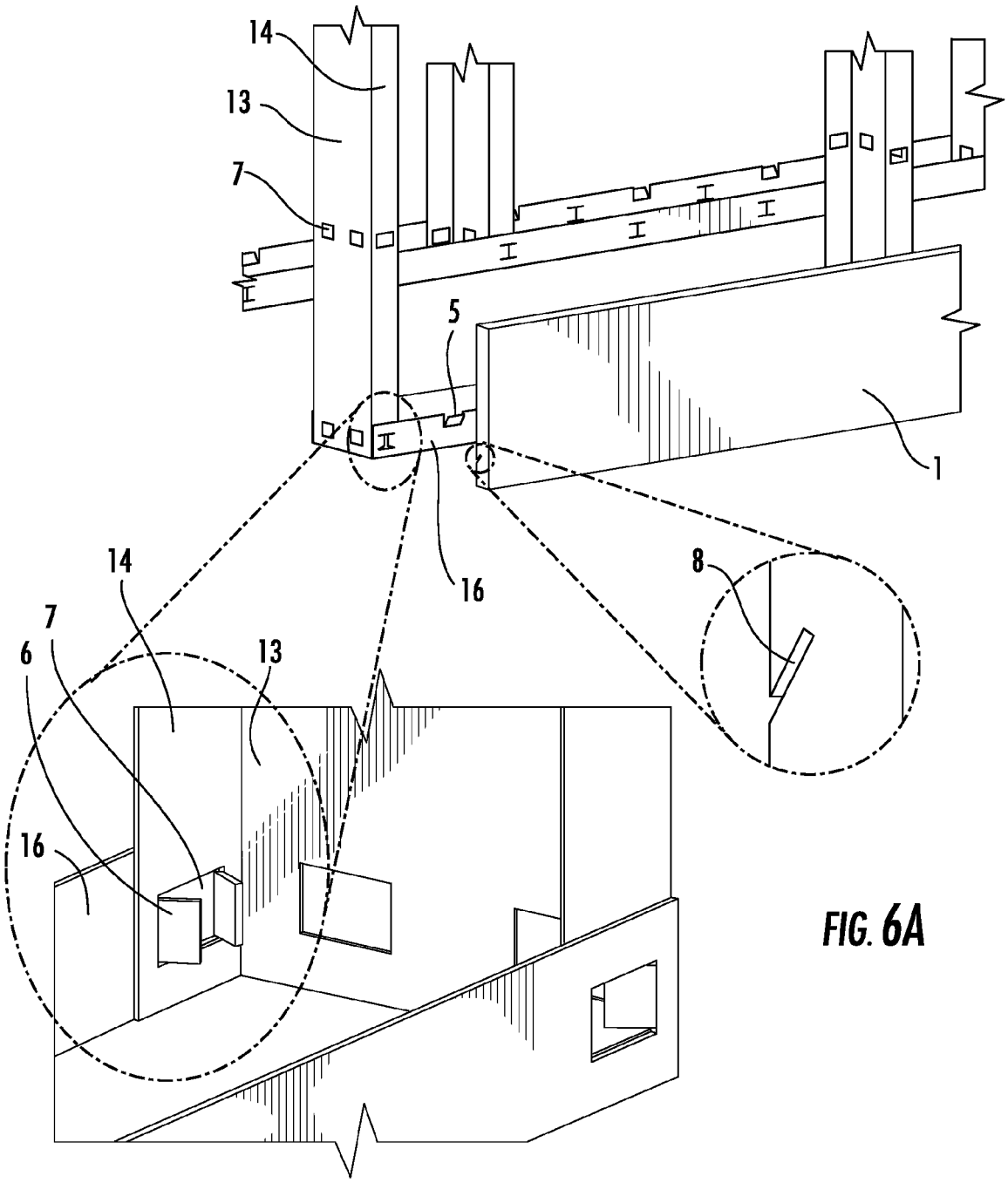
FIGS. 6A-B are schematic drawings showing a representative frame and baseboard prior to assembly (FIG. 6A) and assembled (FIG. 6B) according to the invention.
Figure 6B:
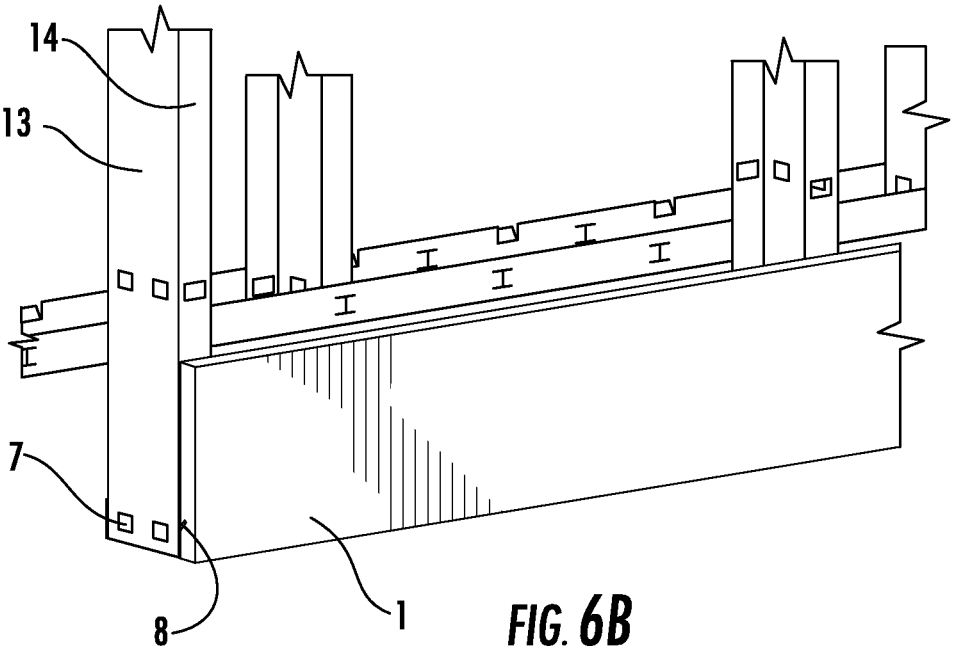

FIG. 5 shows an embodiment according to the invention wherein wall panels 1 are installed on an assembled frame. In another embodiment, a shelving unit 1B can be installed on the frame between wall panel units. Further, in other embodiments wall panels 1 of different finishes may be installed on the frame. Individual wall panels 1 of the system are preferably made of CNC cut medium density fiberboard and may have any desired finish material, including wood veneer, acrylic, and laminate, and may take the form of solid colors, patterns, or smooth or contoured surfaces. However, this list is not intended to be all inclusive, and other finishes or appearances may be apparent to a skilled artisan. The panels 1 may also be made of other materials such as fiberboards of other densities, hardwood, various polymers, stone, or glass. Further, panels 1 of the wall systems need not be identical. Systems according to the invention may use panels 1 of different materials, finishes, colors, patterns, or surfaces for aesthetic effect. On the other hand, in many embodiments all of the panels 1 within a given wall system will be substantially identical in these characteristics. FIGS. 6A-B are schematic drawings showing a representative frame and baseboard prior to assembly (FIG. 6A) and assembled (FIG. 6B).

Figure 7A:
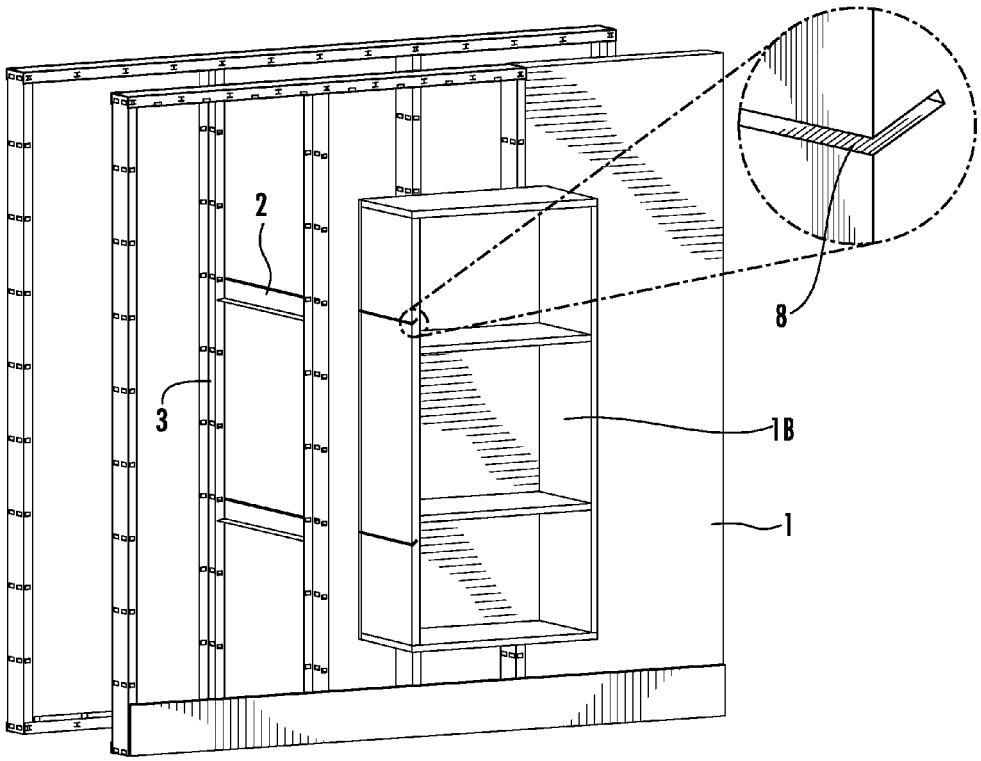
FIGS. 7A-B are schematic drawings showing a frame and shelving unit prior to assembly (FIG. 7A) and assembled (FIG. 7B) according to the invention.
Figure 7B:
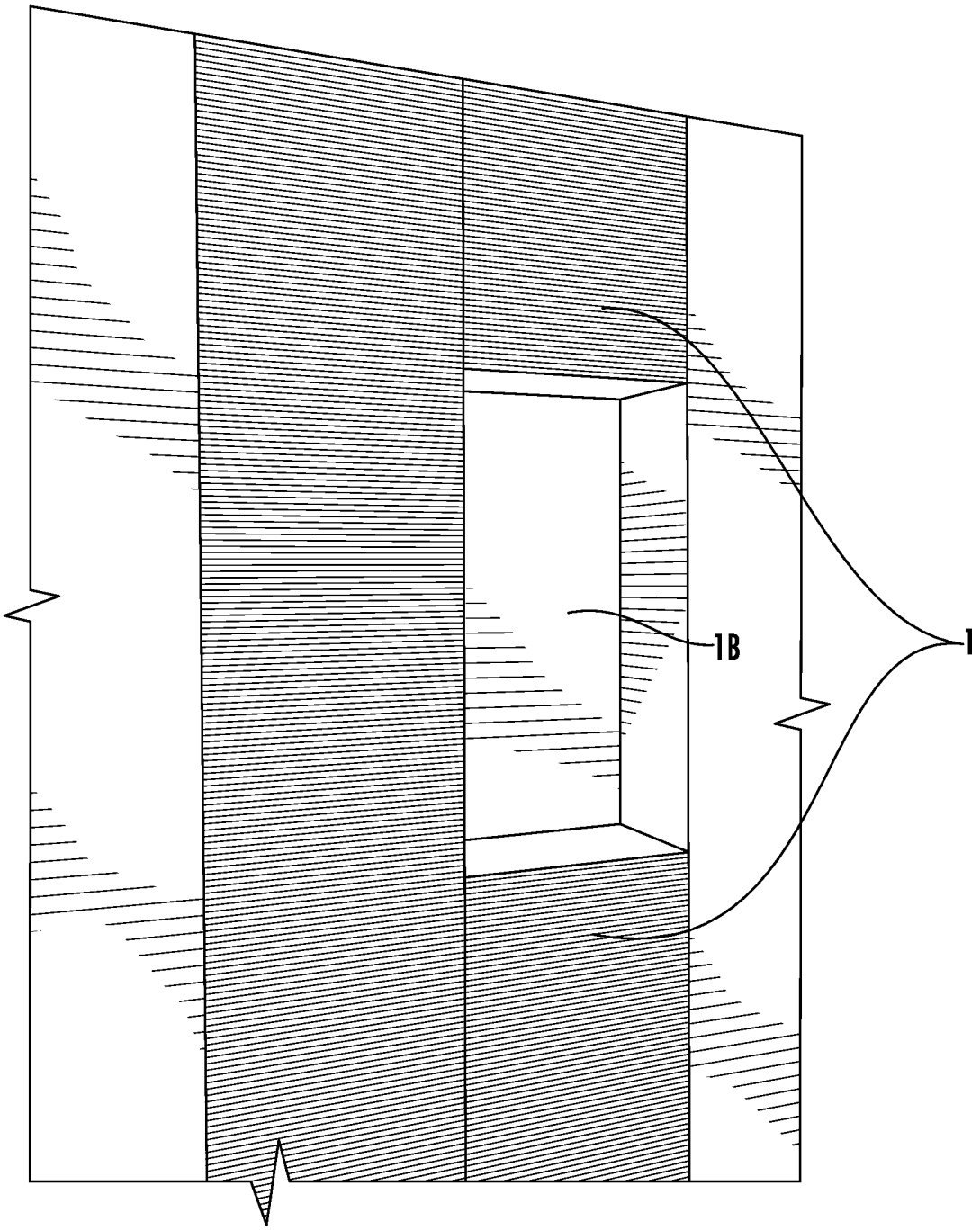
Figure 8:
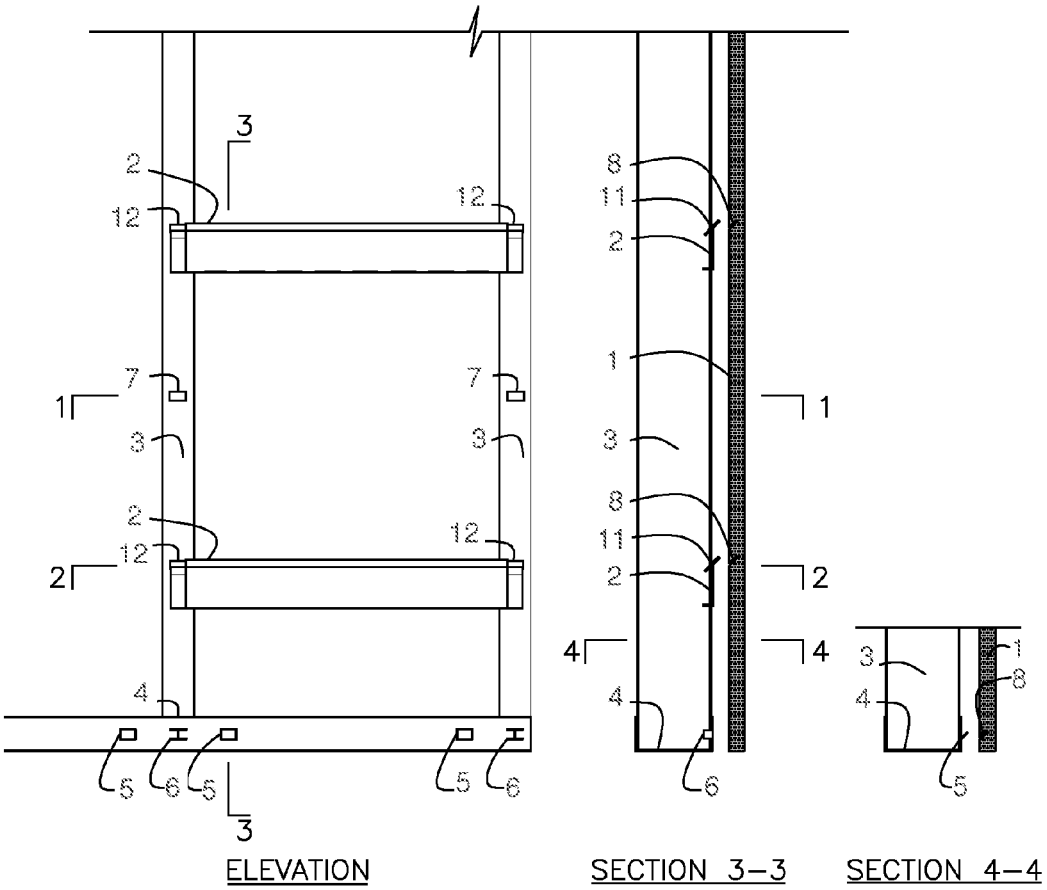
FIGS. 8 and 9 are schematic drawings showing a modular wall assembly (FIG. 8) and cross-sectional views of the assembly (FIG. 9) according to the invention.
Figure 9:
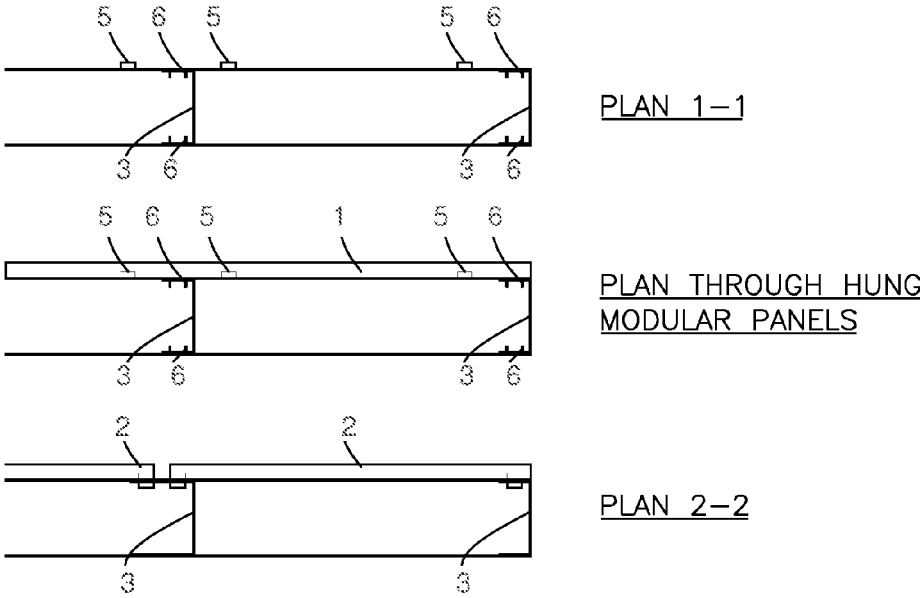

Further, individual wall panels 1 may be configured to confer specific functions according to particular settings. For example, panels 1 may configured to accommodate peripheral components such as electrical components, data ports, cable TV outlets, communications ports, speakers, and the like, for home or home office settings. In various embodiments, fasteners may be preinstalled on individual wall panels 1 for hanging pictures, mirrors, flat panel TVs/HDTVs or computer monitors, and the like. Alternatively, systems according to the invention may be configured to include shelving for books, knickknacks, and the like as the embodiment shown in FIG. 7B as well as cabinets or entertainment centers, or access panels for hidden compartments inside the framing such as safes. FIGS. 7A-B are schematic drawings showing a frame and shelving unit prior to assembly (FIG. 7A) and assembled (FIG. 7B). The systems of the invention allow these features to be placed in the home or office at any desired location.

In an embodiment, for example, CNC cut medium density fiberboard wall panels 1 and bookshelf 1B are installed on a CNC cut metal framing system 20. The interior of the assembled frames 20 of the invention (i.e. between the modules of a wall) may be fitted with acoustic or thermal insulation or any combination thereof. For example, thermal insulation such as blanket rolls of fiberglass, mineral wool, plastic fibers, or natural fibers may be installed as well as foam boards such as polystyrene, polyisocyanurate, or polyurethane. Similarly, panels or sheets of acoustic foam such as polyurethane foam or mass loaded vinyl, as well as acoustic board or tile may be installed. Similarly, the metal framing components of the invention or parts of these components (e.g. male and female engagement means) may be modified to comprise an insulating layer comprised of these or other materials to minimize heat or sound conduction through the frame itself. The metal wall framing components may also include insulation attached to the face of the framing components such as a thin foam strip to insure a tight seal and provide acoustical protection.

FIGS. 8-11 are schematic diagrams showing additional views of modular wall assemblies and their components according to various embodiments of the invention.

The modular wall assembly system of the invention can be used in any setting where an interior wall is desired, including home, office, retail stores, restaurants, plants, hospitals, and the like. The system of the invention can be installed without the need for specialized contractors or special tools, and panels may be easily replaced by the do-it-yourself home owner who desires easy-to-implement home improvements. As the system allows for easy replacement of wall modules, it provides for frequent interior remodeling without costly, time-consuming, disruptive and messy remodeling projects.

The present invention has been described with reference to particular embodiments having various features. It will be apparent to those skilled in the art that various modifications and variations can be made in the practice of the present invention without departing from the scope or spirit of the invention. One skilled in the art will recognize that these features may be used singularly or in any combination based on the requirements and specifications of a given application or design. Other embodiments of the invention will be apparent to those skilled in the art from consideration of the specification and practice of the invention. The description of the invention provided is merely exemplary in nature and, thus, variations that do not depart from the essence of the invention are intended to be within the scope of the invention.

The invention claimed is:

1. A modular wall assembly system, comprising:

a metal frame, comprising:

(i) at least one hanging bracket comprising a pair of first male engagement tabs and at least one first wall module engagement cleat;

(ii) at least one floor track comprising at least one second male engagement tab and at least one second wall module engagement cleat; and (iii) a pair of vertical studs comprising a series of first female engagement voids configured to receive said first male engagement tabs of the at least one hanging bracket and a series of second female engagement voids configured to receive said second male engagement tabs of the at least one floor track; and at least one wall module comprising at least one horizontal slot configured to receive the first or second wall module engagement cleats such that when installed the wall module is supported on the studs by way of the at least one hanging bracket.

2. The system of claim 1, wherein the at least one hanging bracket comprises:

a flat, longitudinally-extended rectangular support bar; and an orthogonal projection in communication with the support bar;

wherein the first male engagement tabs are disposed at opposing ends of the support bar and protrude on one side of the support bar;

wherein the at least one first wall module engagement cleat is disposed between the first male engagement tabs and protrudes on an opposing side of the support bar as the first male engagement tabs; and wherein the orthogonal projection protrudes on the same side of the support bar as the first male engagement tabs.

3. The system of claim 1, wherein said vertical studs comprise:

a flat rectangular main wall; and two parallel side walls disposed at right angles to the main wall;

wherein the first female engagement voids are disposed at increments along the main wall and the second female engagement voids are disposed at increments along the side walls.

4. The system of claim 1, wherein the at least one floor track comprises:

a flat rectangular base; and two parallel track walls disposed at right angles to the base;

wherein the second male engagement tab and the at least one second wall module engagement cleat are disposed in at least one of the parallel track walls.

5. The system of claim 2, wherein the pair of first male engagement tabs are configured to fold at an angle toward the orthogonal projection.

6. The system of claim 2, wherein the pair of first male engagement tabs are hooks, ridges, or knobs.

7. The system of claim 4, wherein the at least one second male engagement tab is configured to provide a pair of tabs that fold inward and away from one another to engage one of the vertical studs.

8. The system of claim 4, wherein the at least one second male engagement tab is a hook, ridge, or knob.

9. The system of claim 1, wherein the first female engagement voids are slots for receiving tabs that fold at a downward angle.

10. The system of claim 1, wherein the second female engagement voids are slots for receiving a pair of tabs that fold inward.

11. The system of claim 1, wherein during use the first and second wall module engagement cleats are disposed at an upward angle and the horizontal slots of the wall module are disposed at a downward angle for receiving the first and second wall module engagement cleats.

12. The system of claim 1, wherein the at least one hanging bracket, the at least one floor track, and the vertical studs are made of CNC cut sheet metal.

* * * * *